United States Patent [19]

Woltmann et al.

[11] Patent Number: 4,508,159

[45] Date of Patent: Apr. 2, 1985

[54] MOLD WITH FEEDER CHANNEL FOR THE CASTING OF METALS, IN PARTICULAR, FOR LOW-PRESSURE CASTING

[75] Inventors: Reinhard Woltmann, Gröbenzell; Karl Sixt, Munich, both of Fed. Rep. of Germany

[73] Assignee: Bayerische Motoren Werke Aktiengesellschaft, Munich, Fed. Rep. of Germany

[21] Appl. No.: 374,299

[22] Filed: May 3, 1982

[30] Foreign Application Priority Data

May 2, 1981 [DE] Fed. Rep. of Germany ..... 3117408

[51] Int. Cl.[3] ..... B22D 17/06

[52] U.S. Cl. ..... 164/306; 164/113; 164/309

[58] Field of Search ..... 164/113, 119, 303, 309–318, 164/306

[56] References Cited

U.S. PATENT DOCUMENTS

| | | | |
|---|---|---|---|
| 2,671,936 | 3/1954 | Sundwick | 164/316 |
| 3,698,471 | 10/1972 | Chatourel et al. | 164/113 X |
| 4,076,070 | 2/1978 | Lefebvre et al. | 164/119 X |
| 4,172,489 | 10/1979 | Lefebvre | 164/309 |

*Primary Examiner*—Nicholas P. Godici
*Assistant Examiner*—Kurt Rowan
*Attorney, Agent, or Firm*—Walter W. Burns, Jr.

[57] ABSTRACT

A mold which can be used for low-pressure casting, in particular, and has at least two mold parts, comprises a feeder channel which is clamped between the two mold parts at an attachment flange thereof, which is parallel to the parting plane of the mold parts. On a side of the feeder channel provided with inlet channels, which lead from the feeder channel to the mold cavity, the attachment flange of the feeder channel is connected to one of the two mold parts in such a way that it seals against the mold, while having an edge area of the flange which is unconnected and can, therefore, expand under the action of heat.

20 Claims, 2 Drawing Figures

25
19
9'
L
II
II
10
9
4
9''
7
5
2
23
20
21
11
3
12
10
13
22
14'
9''
4
6
19
8
14
24
25
16
15
22
9
9'
18
17
1

MOLD WITH FEEDER CHANNEL FOR THE CASTING OF METALS, IN PARTICULAR, FOR LOW-PRESSURE CASTING

BACKGROUND AND SUMMARY OF THE INVENTION

The invention pertains to a mold for the casting of metals, in particular, for low-pressure casting, with at least two mold parts which are in contact with one another in a parting plane and with a feeder channel, which extends through one of the mold parts, is secured in the area of the parting plane and is connected to the mold cavity by at least one inlet channel.

In a known mold of this type (DE-OS No. 20 37 652, FIG. 7) the feeder channel is bolted to the lower mold part by means of attachment flanges which are parallel to one another and perpendicular to the parting plane in a manner creating an intermediate space therebetween. In this process, the high casting temperatures can cause warping and buckling of the feeder channel, which is rigidly secured at both of its longitudinal sides to the lower mold part. This can have the effect that the mold will no longer close tightly so that liquid metal will discharge in the area of the parting plane. Additionally, this metal can also seep through gaps into the intermediate space which is provided for the purpose of heating the feeder channel and is located between the mold part and the feeder channel. In both cases, smooth operation is no longer ensured.

Thus, a principal object of the invention is to create a mold with a feeder channel of the type mentioned in the introduction in which the feeder channel can expand better without leaking.

This object is achieved in accordance with a preferred embodiment of the invention due to the fact that the essentially trough-shaped feeder channel is clamped between the two mold parts by means of an attachment flange which is essentially parallel to the parting plane; in this process, the flange engages with one of the two mold parts in the area of the inlet openings in such a way as to seal the mold, and elsewhere the flange is unattached at its outer edge.

Because of these measures, the feeder channel is securely anchored to the adjacent mold part in the area of the inlet channels, i.e., on the ingate side. In this area, which is particularly prone to the discharge of liquid metal, gaps are completely avoided due to the fact that the edge of the feeder channel engages with the mold part in such a way as to seal against the mold. Since, with the exception of the ingate side, the attachment flange of the trough-shaped feeder channel is only clamped between the two mold parts and the outer edge of the flange is unattached, i.e., is not restrained anywhere, the attachment flange can expand parallel to the parting plane under the action of the high casting temperatures; in this process, it is still quite possible to ensure the sealing of the flange with respect to the adjacent mold parts.

In the preferred practical implementation of the invention, the fact that the attachment flange engages in such a way as to seal against the mold secures this flange approximately parallel to the parting plane with respect to the mold part and vertically with respect to the longitudinal extension of the flange. This can be preferably achieved with the aid of a spline-like key, which runs parallel to the attachment flange, is inserted into an approximately horizontal support shoulder of the lower mold part and engages in a channel on the underside of the attachment flange. Therefore, the attachment flange can expand in its longitudinal direction; in this process, perpendicular to the longitudinal extension of the flange, the mold sealing engagement which is required for good ingate-side sealing is retained, and this engagement secures the flange to the adjacent mold part of the ingate side without leaving any gap.

It is a good idea for the attachment flange to be secured on the ingate side at one point in its longitudinal extension in such a way that it seals the mold. This reliably secures the feeder channel in its position. Since the attachment flange is secured at only a single point, however, the flange can still expand from this point in both longitudinal directions.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figures 1, 2:
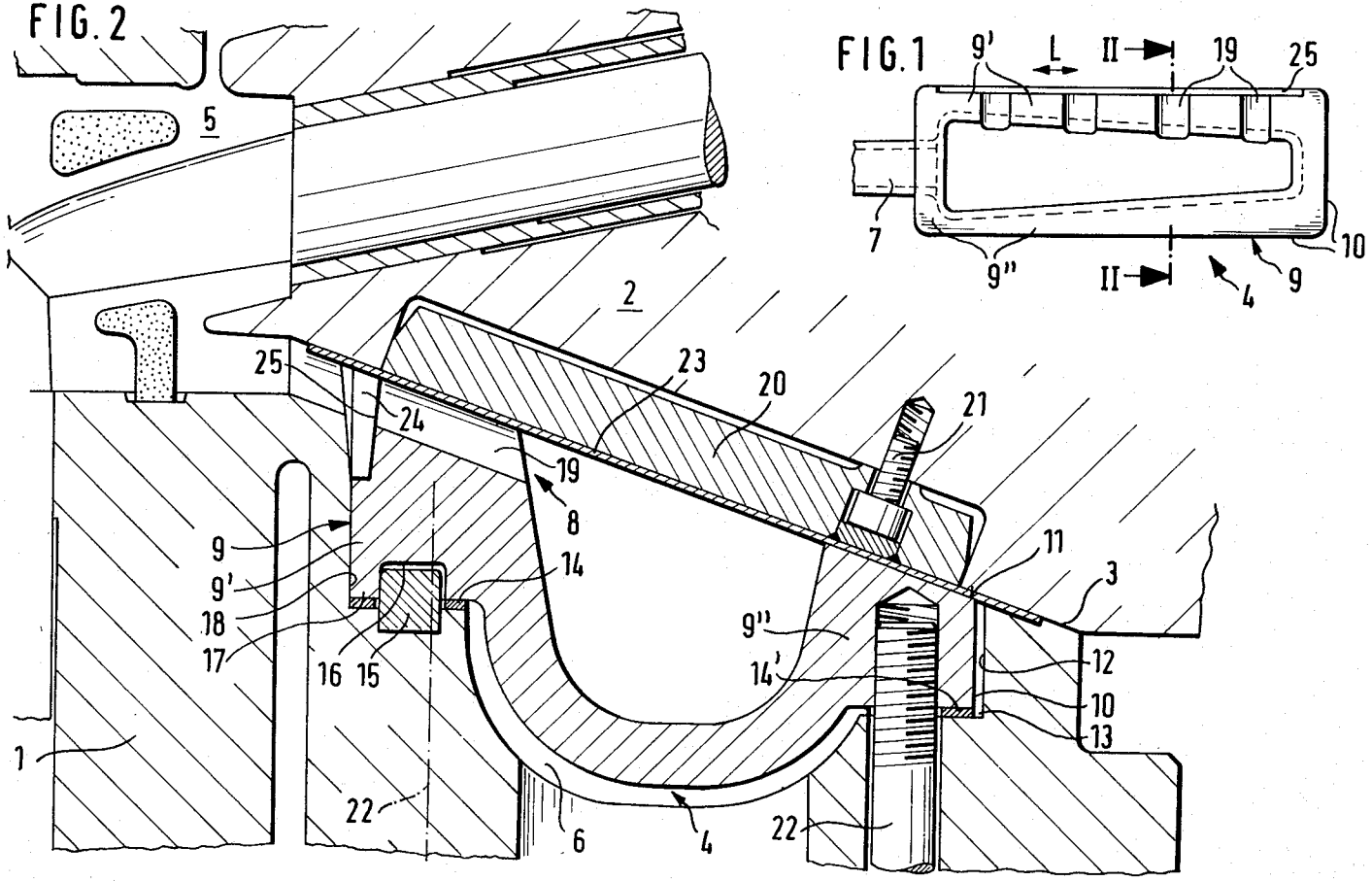
FIG. 1 shows a top view of the feeder channel of the new mold.
FIG. 2 shows a section along the II—II line in FIG. 1, but with the adjacent mold parts as well.

In the drawing, sections of a lower mold part 1 and an upper mold part 2, which are rigidly in contact with one another in a parting plane 3 when the mold is closed, are shown. Through feeder channel 4, the liquid metal can be fed to mold cavity 5 in accordance with the principle of low-pressure casting. An intermediate space 6, which can also be used to heat feeder channel 4, is formed between lower mold part 1 and channel 4, which extends through the lower mold part 1 with its feed nozzle 7. Several inlet channels 8 are provided for connecting feeder channel 4 to mold cavity 5.

The essentially trough-shaped feeder channel 4 is elongated longitudinally and has a channel cross-section which tapers from feed nozzle 7 to the opposite end of the channel. At the upper edge of the trough, feeder channel 4 is equipped with an attachment flange 9 which is approximately parallel to the parting plane 3 and with which the channel is clamped between the two mold parts 1 and 2. In this process, in area 9' of inlet openings 8, attachment flange 9 engages with lower mold part 1 in such a way as to seal the mold, while the rest of the area 9' of attachment flange 9 is unattached at its outer edge 10. Upper flange plane 11 lies approximately in parting plane 3. When the mold is closed, feeder channel 4 is also closed from above.

As FIG. 2 shows, between the outer free edge 10 of attachment flange 9'' and adjacent wall surfaces 12 of lower mold part 1 there are expansion gaps 13.

The fact that area 9' of attachment flange 9 engages in such a way as to seal against the mold secures the flange with respect to lower mold part 1 in a direction which is approximately parallel to parting plane 3 and perpendicular to the longitudinal extension L of the flange 9. In the case of the preferred embodiment shown in the drawing, this is done by means of a spline-like key 15, which runs parallel to attachment flange 9, being inserted into an approximately horizontal support shoulder 14 of lower mold part 1 and engages in a groove 16 on the underside of attachment flange 9.

In order to ensure a particularly tight and flush connection of area 9′ of attachment flange 9 with lower mold part 1, flange part 17, which forms the outer limit of groove 16, engages, in the space between spline-like key 15 and wall surface 18 of lower mold part 1, with the wall surface adjoining the outer edge of attachment flange 9 on the feeder and ingate side.

In order to precisely secure feeder channel 4 in position, on the ingate side, attachment flange 9 is secured at one point in the longitudinal direction, preferably in the center of its longitudinal extension L.

Inlet channels 8, which connect feeder channel 4 to mold cavity 5, can be formed by recesses 19 in attachment flange 9 which are set back from flange plane 11.

As shown in FIG. 2, in upper mold part 2, there can be a replaceable plate 20 which covers trough-shaped feeder channel 4. Thus, in the same way as feeder channel 4, which is also highly stressed, the thermally very highly stressed plate can easily be replaced if, after a certain period of operation, damage occurs in these areas. Screws 21, which are covered by a ground plug, serve to secure plate 20. Plate 20 is arranged in large areas with an intermediate space between it and mold part 2. Feeder channel 4 is secured to mold part 1 in the vertical direction by screws 22, the presence of only one of which is indicated, and which must have a certain radial play with respect to the attachment holes in mold part 1, so as not to interfer with expansion of the channel 4 radially with respect to the screws.

As FIG. 2 of the drawing shows, there is a fireproof and heat-insulating sealing mat 23 between trough-shaped feeder channel 4 and the plate 20 which covers it. Sealing mat 23, which is generally reinserted before each casting process, prevents the liquid metal from penetrating forward to intermediate space 6 and, in particular, to expansion gaps 13. If expansion gaps 13 were filled with solidified material after several casting processes, the way for the attachment flange to expand as described, approximately parallel to parting plane 3, would no longer be ensured. Therefore, sealing mat 23 also covers expansion gaps 13 and inlet channels 8.

Due to the fact that, in the preferred embodiment shown here, as FIG. 2 indicates, the attachment flange 9″, located away from the ingate side, approaches parting plane 3 in the shape of a wedge, there is an increase in the sealing effect in the area of the sealing mat when feeder channel 4 undergoes thermal expansion.

FIG. 2 of the drawing also shows that, at the end of attachment flange 9, which faces mold cavity 5, there is a screen 24 which covers the cross section of inlet channels 8. This screen 24 promotes a controlled separation point in the transition range of the metal from liquid to solid from the mold part ingate to the joint ingate. In addition, screen 24 keeps out impurities and oxide skins. Screen 24 is located in a longitudinal groove 25, which is parallel to attachment flange 9, that is essentially formed in the outer edge of the flange 9′ and is, in use, bounded on one side by wall surface 18 of lower mold part 1. In place of this screen 24, it is also possible to use a filter, for instance one made of steel wool.

While we have shown and described a single embodiment in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. Mold defining a mold cavity for the casting of metals, in particular, for low-pressure casting, comprising at least two mold parts which are joinable with one another along a parting plane, and a trough-shaped feeder channel which extends through one of the mold parts while defining an intermediate space therebetween, said feeder channel communicating with the mold cavity by at least one inlet channel, wherein the trough-shaped feeder channel is clamped between the two mold parts at an attachment flange means thereof, a top edge of said flange means being approximately parallel to said parting plane, a side edge of said flange arranged for positively engaging one of the two mold parts in at least the area of said inlet channel to form a seal and, at least the opposite side edge of said flange in another area, being connected in a manner for permitting thermal expansion of the trough-shaped feed channel with respect to said mold parts in a direction parallel to said parting plane.

2. Mold in accordance with claim 1, wherein the two mold parts comprise an upper and a lower mold part, and wherein the feeder channel is connected to the lower of the two mold parts.

3. Mold in accordance with claim 2, wherein an upper surface of the attachment flange means lies approximately in said parting plane.

4. Mold in accordance with claim 1 or 2 or 3, wherein the attachment flange means further comprises means defining expansion gaps between an outer free edge of the attachment flange means and adjacent wall surfaces of the mold part.

5. Mold in accordance with claim 1, wherein sealing the positive engagement of the attachment flange means secures the flange with respect to said one of the mold parts in a direction approximately parallel to said parting plane, and perpendicular to the longitudinal extension of the flange means.

6. Mold in accordance with claim 5, wherein the attachment flange comprises means defining expansion gaps between an outer free edge of the attachment flange and adjacent wall surfaces of the mold part.

7. Mold in accordance with claim 1, further comprising means sealingly fixing at only a single point the attachment flange means to said one of the mold parts against relative movement parallel to the longitudinal extension of the flange for allowing expansion at other points on the flange means.

8. Mold in accordance with claim 7, wherein the single fixed-point of the attachment flange means is located in the center of its longitudinal extension.

9. Mold in accordance with claim 1, wherein the attachment flange means further comprises means for defining plural inlet channels formed by recesses.

10. Mold in accordance with claim 2, wherein, in the upper mold part, there is a replaceable plate which covers the trough-shaped feeder channel when the mold parts are joined.

11. Mold in accordance with claim 1 or 10, wherein, between the trough-shaped feeder channel and the other of the two mold parts, there is a fireproof and heat-insulating sealing mat.

12. Mold defining a mold cavity for the casting of metals, in particular, for low-pressure casting, comprising at least two mold parts which are joinable with one another along a parting plane, and a trough-shaped feeder channel which extends through one of the mold parts while defining an intermediate space therebetween, said feeder channel communicating with the mold cavity by at least one inlet channel, wherein the trough-shaped feeder channel is clamped between the two mold parts at an attachment flange thereof, said flange being approximately parallel to said parting plane, positively engaging one of the two mold parts in an area of said inlet channel to form a seal and, in another area, being connected in a manner permitting thermal expansion thereof, the positive engagement of the attachment flange secures the flange with respect to said one of the mold parts in a direction approximately parallel to said parting plane, and perpendicular to the longitudinal extension of the flange, wherein the two mold parts comprise an upper and a lower mold part, and wherein the feeder channel is connected to the lower of the two mold parts, comprising at least one spine-like key, which runs parallel to the attachment flange, is inserted into an approximately horizontal support shoulder of the lower mold part and engages in a groove defined by the underside of the attachment flange.

13. Mold in accordance with claim 12, wherein a flange part, which forms an outer boundary of said groove, engages, without play, in a space between and defined by the spline-like key and a wall surface of the lower mold part, said wall surface adjoining an outer edge of the attachment flange.

14. Mold defining a mold cavity for the casting of metals, in particular, for low-pressure casting, comprising at least two mold parts which are joinable with one another along a parting plane, and a trough-shaped feeder channel which extends through one of the mold parts while defining an intermediate space therebetween, said feeder channel communicating with the mold cavity by at least one inlet channel, wherein the trough-shaped feeder channel is clamped between the two mold parts at an attachment flange thereof, said flange being approximately parallel to said parting plane, sealingly engaging one of the two mold parts in an area of said inlet channel and, in another area, being connected in a manner permitting thermal expansion thereof, wherein the attachment flange further comprises means defining expansion gaps between an outer free edge of the attachment flange and adjacent wall surfaces of the mold part wherein the attachment flange further comprises means for defining plural inlet channels formed by recesses, and wherein, between the trough-shaped feeder channel and the other of the two mold parts, there is a fireproof and heat-insulating sealing mat, said sealing mat covering the expansion gaps and inlet channels.

15. Mold in accordance with claim 1, wherein, in an end of the attachment flange means, which faces a mold cavity of the mold, there is a screen which covers the cross-section of the inlet channels, so that metal being cast must flow therethrough from the feeder channel to the mold cavity.

16. Mold in accordance with claim 15, wherein said screen is situated in a longitudinal groove which is parallel to the attachment flange, and which is defined by and between an outer edge of the flange and an adjacent portion of said one of the mold parts.

17. Mold, defining a mold cavity for the casting of metals, in particular, for low-pressure casting, comprising at least two mold parts which are joinable with one another along a parting plane, and a trough-shaped feeder channel which extends through one of the mold parts while defining an intermediate space therebetween, said feeder channel communicating with the mold cavity by at least one inlet channel, wherein the trough-shaped feeder channel is clamped between the two mold parts at an attachment flange thereof, said flange being approximately parallel to said parting plane, sealingly engaging one of the two mold parts in an area of said inlet channel and, in another area, being connected in a manner permitting thermal expansion thereof, wherein sealing engagement of the attachment flange secures the flange with respect to said one of the mold parts in a direction approximately parallel to said parting plane, and perpendicular to the longitudinal extension of the flange, wherein the two mold parts comprise an upper and a lower mold part, and wherein the feeder channel is connected to the lower of the two mold parts, comprising at least one spline-like key, which runs parallel to the attachment flange, is inserted into an approximately horizontal support shoulder of the lower mold part and engages in a groove defined by the underside of the attachment flange, and wherein, at a side of said feeder channel opposite said inlet channel, the attachment flange is fastened to said one of the mold parts in a direction substantially perpendicular to the parting plane in a manner enabling expansion thereof in directions parallel thereto.

18. Mold in accordance with claim 12 or 17, wherein the attachment flange comprises means defining expansion gaps between an outer free edge of the attachment flange and adjacent wall surfaces of the mold part.

19. Mold in accordance with claim 14, wherein the two mold parts comprise an upper and a lower mold part, and wherein the feeder channel is connected to the lower of the two mold parts.

20. Mold in accordance with claim 19, wherein an upper surface of the attachment flange lies approximately in said parting plane.

* * * * *